United States Patent [19]

Deeken

[11] 4,375,444

[45] Mar. 1, 1983

[54] METHOD FOR THE ELIMINATION OF CIRCUMFERENTIAL STRESS CRACKS IN SPUN POLYESTERS

[75] Inventor: William O. Deeken, Stow, Ohio

[73] Assignee: The Goodyear Tire & Rubber Company, Akron, Ohio

[21] Appl. No.: 341,405

[22] Filed: Jan. 21, 1982

Related U.S. Application Data

[62] Division of Ser. No. 77,417, Sep. 20, 1979, Pat. No. 4,328,108.

[51] Int. Cl.[3] ..... B29G 5/00

[52] U.S. Cl. ..... 264/136; 264/210.3; 264/289.3; 264/290.5

[58] Field of Search ..... 252/8.6; 8/115.6; 264/136, 210.3, 289.3, 290.5

[56] References Cited

U.S. PATENT DOCUMENTS

| | | | |
|---|---|---|---|
| 3,113,369 | 12/1963 | Barrett et al. | 264/210.3 |
| 3,329,758 | 7/1967 | Morgan et al. | 264/210.3 |
| 3,335,209 | 8/1967 | Morgan et al. | 264/210.3 |
| 3,452,132 | 6/1969 | Pitzl | 264/130 |
| 3,549,740 | 12/1978 | Schwarz | 264/210.3 |
| 3,850,658 | 11/1974 | Gomez et al. | 264/210.3 |
| 3,988,086 | 10/1976 | Marshall et al. | 264/210.3 |
| 4,019,990 | 4/1976 | Marshall et al. | 264/210.3 |
| 4,054,634 | 10/1977 | Marshall et al. | 264/210.3 |
| 4,070,432 | 1/1978 | Tamaddon | 264/210.3 |
| 4,177,231 | 12/1979 | Kleber et al. | 264/130 |
| 4,210,700 | 7/1980 | Marshall et al. | 252/8.7 |

FOREIGN PATENT DOCUMENTS

| | | | |
|---|---|---|---|
| 41-16133 | 9/1966 | Japan | 264/136 |
| 44-15571 | 7/1969 | Japan | 428/364 |
| 49-1257 | 1/1974 | Japan | 264/136 |
| 52-55794 | 5/1977 | Japan | 264/210.3 |
| 1082795 | 9/1967 | United Kingdom | 264/210.3 |

*Primary Examiner*—Jay H. Woo

*Attorney, Agent, or Firm*—Bruce Hendricks; D. J. Hudak

[57] ABSTRACT

A method for the elimination of circumferential stress cracks that occur during production of spun polyesters is provided. The cracks are eliminated by the use of an organic solvent miscible with the lubricating emulsion applied during the finish operation before draw twisting of the spun polyester. The organic solvent may be kerosene or mineral oil or solutions containing the same.

3 Claims, No Drawings

METHOD FOR THE ELIMINATION OF CIRCUMFERENTIAL STRESS CRACKS IN SPUN POLYESTERS

CROSS-REFERENCE

This application is a divisional application of my previous application bearing Ser. No. 077,417 filed Sept. 20, 1979 and now U.S. Pat. No. 4,328,108 "METHOD AND COMPOSITION FOR THE ELIMINATION OF CIRCUMFERENTIAL STRESS CRACKS IN SPUN POLYESTERS".

BACKGROUND OF THE INVENTION

This invention relates to the use of solvents in the finish application of solvents in the finishing operation of spun polyester yarns and the method for the production of spun polyester yarns where the finish application eliminates circumferential stress cracking.

Heretofore, spun polyesters produced by conventional processes including melt spinning, finishing, winding and draw twisting, have been susceptible to defects within the structure of each individual filament. These defects include circumferential stress cracking in each filament which seriously weakens the oriented strength of the filaments and the yarn produced therefrom.

In the conventional production of spun polyester, the melt spinning process where the filaments are formed through the spinnerette is followed by the application of a finish coat to prepare the filaments which are wound together for subsequent draw twisting. This finishing operation has typically employed various proprietary emulsion compositions which lubricate the filaments in preparation for draw twisting under elevated temperature and drawing conditions. An emulsion such as Nopcostat, a proprietary solution produced by the Diamond Shamrock Corporation has conventionally been prepared in proper concentration in an aqueous solution.

With the use of aqueous solutions, circumferential cracks in the filaments of the spun polyester yarn appear after the yarn has been melt spun during production time lags. These cracks seriously weaken the spun yarn before their orientation in draw twisting, such that draw twisting cannot be performed on these defective filaments, even though the conditions of melt spinning, production lag time, and draw twisting are well within conventional requirements. Therefore, a different solvent system is necessary for the emulsion that lubricates and finishes the filaments following melt spinning prior to draw twisting. Use of a different solvent could minimize or eliminate circumferential stress cracks in the spun polyester yarns.

OBJECTS OF THE INVENTION

Therefore, it is an object of the present invention to provide a solvent system for the emulsion which lubricates the filaments forming spun polyester yarns, such that circumferential stress cracking in those yarns is minimized or eliminated by interaction of the solvent system with the yarns.

Another object of the invention is to provide a solvent system which is miscible with an emulsion and yet minimizes or eliminates circumferential stress cracking in spun polyester yarns without deleteriously affecting the other processing requirements in the subsequent yarn processing operations.

Still another object of the invention is to provide a process for applying a filament finishing operation whereby the circumferential stress cracking in spun polyester yarns is minimized or eliminated.

Moreover, it is an object of the invention to provide a finishing operation, as above, where the tensile strength and tenacity of the final drawn spun polyester yarn is unexpectedly increased.

Yet another object of the invention is to provide a solvent system, as above, where the combination of the solvent system with the yarn increases the tenacity and tensile strength of the spun polyester yarn.

Yet another object of the invention is to provide a solvent system and a method for incorporating the same, as above, whereby the time delay between various operations in the production of spun polyester yarns may be increased without deleteriously affecting the physical properties of the final spun polyester yarn.

These and other objects, which will become more apparent as the detailed description of the preferred embodiment proceeds, are achieved by: a process to minimize circumferential stress cracking in spun polyester filaments, comprising: mixing a miscible solution of a fiber finishing emulsion and an organic solvent, said emulsion having emulsifiers, lubricating oils, antistat oils and heat stabilizers; said organic solvent selected from the group consisting of mineral oil, kerosene, and combinations thereof; melt spinning polyester fiber; contacting said solution with the fiber; storing the spun polyester; and draw twisting the spun polyester to produce a spun polyester yarn having minimal circumferential stress cracks.

Further, the objects of the invention are achieved by: a composition of matter for lubrication of spun polyester filaments susceptible to circumferential stress cracking, comprising: a miscible solution having a fiber finishing emulsion having emulsifiers, lubricating oils, antistat oils, and heat stabilizers; and an organic solvent miscible with said emulsion selected from the group consisting of mineral oil, kerosene, and combinations thereof; said emulsion comprising from about 10 to about 50 percent of said solution and said organic solvent from about 50 to about 90 percent of said solution.

DETAILED DESCRIPTION OF THE PREFERRED EMBODIMENT

The appearance of circumferential stress cracking before draw twisting in spun polyester yarns is a defect resulting directly from the solvent system provided for the emulsion which lubricates the filaments prior to draw twisting. In the conventional production of spun polyester yarns, there is a production time lag between the spinning operation and the draw twisting operation, typically twenty-four hours. During this production time lag, the emulsion in the aqueous solvent system, during the finishing operation immediately after melt spinning, lubricates the filaments for subsequent draw twisting. However, it has been found that the conventional aqueous solvent system attacks the surface of the filaments during the production time lag. When the filaments are drawn and twisted, if that is indeed possible, the yarn exhibits serious fragility during the orientation thereof. Circumferential stress cracks appear in the filaments during the production time lag and prevent strengthening orientation during the draw twisting operation, such that the filaments lack the requisite physical properties to be used in conventional polyester applications such as fabrics, yarns, textile, and tire manufacturing.

It has been found that the aqueous solvent system counteracts the lubricating properties of the emulsion by attacking the outer surface of the spun yarns, whereby crystallization of the exposed polyester and absorption of water generate the circumferential stress cracks. The depth of the circumferential stress cracks is related to the period of exposure and the extent of water absorption. This attack upon the outer surface by the aqueous system can occur within the period of twenty-four hours, well within acceptable production time lag requirements between the melt spinning operation and the draw twisting operation.

The substitution of an aqueous system with an organic solvent system minimizes or eliminates the crystallization of the polyester and absorption of water. Instead, the organic system may coat the filaments, such that the solvent synergistically aids the finishing oil emulsion or fiber lubricant in the lubrication and preparation of the yarn for draw twisting. The substitution with an organic solvent system must use organic compositions compatible with the emulsions, and specifically be miscible therewith. Further, the organic solvent system must not interfere with the lubricating process engaged by emulsion upon the filaments between the spinning and draw twisting operation during the production lag time.

The substitution of the organic solvent system does not interfere with the otherwise conventional aspects of the production for spun polyester yarns. The minimization or elimination of circumferential stress cracking applies equally as well to multifilament yarns having from about 2 to greater than 200 filaments per yarn or a monofilament yarn, the term fiber meaning either a monofilament or multifilament spun product. The polyethylene terephthalate modified with polyethers, polymeg (a proprietary product of the Quaker Oats Co.) or Carbowax (a proprietary product of the Union Carbide Co.) The copolyesters are so modified to improve dye receptivity and obtain cationic or anionic dyeable copolyesters. Because the substitution of the organic solvent system does not otherwise affect the melt spinning, draw twisting, or storage properties for these cationic or anionic dyeable copolyesters, it may be said that the conventional reaction parameters may be employed in each of these operations without altering the improved finishing and lubrication of the yarn between spinning and draw twisting achieved according to this invention.

The fiber finishing emulsion which lubricates the filaments in the yarn comprises from about 10 to about 50 percent of the total volume of the finishing solution. Therefore, the organic solvent system comprises from about 90 to about 50 percent of the volume of the solution. Preferably, the emulsion comprises about 25 percent and the organic solvent system comprises about 75 percent of the total solution.

Any emulsion known to those skilled in the art and existing in commercial operations may be used to lubricate and treat the filaments to prepare the yarn for draw twisting. Typically, these emulsions are normally subject to proprietary secrecy and may be identified only according to their trade names. However, it is known that these emulsions comprise emulsifiers, lubricating oils, antistat oils, and heat stabilizers. Preferably, Nopcostat 270, a proprietary solution produced by Diamond Shamrock Corporation, has been found to be an excellent finishing emulsion to lubricate the yarn for draw twisting. Other emulsions or fiber lubricants include Stantex #7377, 7437, 7730, 7311, 7430 from Standard Chemical Co. and Nopcostat #1296-C from Diamond Shamrock Corp.

The organic solvent must be miscible with the emulsion to provide a homogeneous solution thereof. Further, the organic solvent must not interrupt the lubricating action of the emulsion after the finishing operation has occurred. It has been found that organic solvents such as kerosene, mineral oil, Varsol 18 from Exxon Corp., with a tagged closed cup rating of 107° F. and No. 467 Solvent from Ashland Chemical Corp., with tagged close cup rating of 190° F. provide excellent coating of the filaments to prevent crystallization of the polyester in the yarn without interfering with the lubricating actions of the emulsion. Preferably, kerosene or mineral oil provide excellent results. The kerosene used in this invention is characterized as being petroleum hydrocarbons chiefly of the methane series having from 10 to 16 carbon atoms per molecule, or known as the fifth fraction in the distillation of petroleum and having a boiling point from 175° F. to 325° F. The mineral oil used in this invention is characterized as liquid paraffin, a mixture of liquid hydrocarbons from petroleum. These organic solvents selected are miscible with the emulsion lubricant and are readily removable from the yarn to promote the efficiency of the dye operation.

The finish operation may be performed in either of two methods which are commonly known to those skilled in the art. The first method employs a kiss roll which provides a revolving contact of the roll, having the finishing solution thereon, with the yarn as it passes the kiss roll. A reservoir supplies the necessary finishing solution to replace that which is transferred to the yarn by direct contact. The second method is a metering head which again provides sufficient contact with the passing yarn. The volume of finish solution to be applied to the yarn is dependent upon the speed of the passing yarn and the adequacy of supply of the finishing solution. No special speed setting or temperature or pressure conditions exist for the transfer of the finishing solution to the moving yarn.

By the minimization or elimination of circumferential stress cracking, without the interference of lubrication, the emulsion in the organic solvent system may allow additional time lag periods during the transfer of production from the melt spinning operation to the draw twisting operation. Whereas, the conventional time period may be about 24 hours between the time spinning is completed before draw twisting is begun, it has been found that up to 90 hours is permissible for production time lags. This 90 hour potential exists because the lubrication of the yarns by the conventional emulsion for draw twisting is not disrupted by the organic solvent, and the organic solvent prevents circumferential stress cracks which are so prevalent during any delay in the production process using the conventional aqueous solvent system.

While the emulsion lubricates the yarn for draw twisting, and the organic solvent system prevents circumferential stress cracking, the combination of these two chemicals synergistically produces improved physical properties in the tenacity or tensile strength of the drawn yarn. Therefore, the substitution with an organic solvent system not only affects the production lag time but also affects the physical properties of the yarn during draw twisting.

To serve as an illustration of the elimination of circumferential stress cracking, the improvement of the final drawn yarn physical properties, and the potential for greater storage time between spinning and draw twisting, reference is made to the following example.

EXAMPLE

Two samples of polyether modified polyethylene terephthalate copolyesters were extruded and spun according to the following conditions labeled in Table I.

TABLE I

| | |
|---|---|
| Spinning Conditions | 1" NRM Extruder |
| Spinnerette | .010" × .013"/35 |
| Filter Pack S.S. | 20, 80, 250, 325, 250, 325, 250, 80, 20 + grit. full cup |
| Pump Size | 1.752 cc/rm |
| Pump Speed | 33.0 RPM |
| Screw Type | 4.5:1 compression ratio |
| Zone 1 | 520° F. |
| Zone 2 | 530° F. |
| Pump Block | 530° F. |
| Spinnerette Block | 530° F. |
| Finish Roll Speed | 35.0 RPM |
| Godet Roll Speed | 2200 RPM/1100 M/Min. |
| Screw Pressure | 2000 (PSI) |
| Pack Pressure | 1300 (PSI) |
| Quench Air Flow | 50 RPM |

One-half of the spun polyester was finished with a solution comprising 20 percent Nopcostat (FT-270) and 80 percent water. The remaining half of the spun polyester was treated with a solution comprising 40 percent Nopcostat (FT-270) and 60 percent kerosene sold by Ashland Chemical Corporation as No. 467. After finishing, both samples were stored for a period of one hour and then proceeded to the draw twisting operation which reaction parameters are described in Table 2.

TABLE 2

| Processing Conditions: | |
|---|---|
| Cot Roll | 1½ wraps |
| Feed Roll | 85° C. @ 7 wrap |
| Platen | 150° C. @ 10" contact |
| Draw Roll | Ambient @ 6 wraps |
| Draw Ratio | 3.91 × |
| Rate of Draw | 546 m/min. |

After the completion of the draw twisting, the physical properties of the drawn spun polyesters yarn were compared between the two samples. Table 3 demonstrates the physical properties subject to comparison.

TABLE 3

PHYSICAL PROPERTIES OF SPUN AND DRAWN YARN

| Type of Finish | Aqueous Base | Organic Solvent Base |
|---|---|---|
| Spun Yarn Birefringence | .0056 | .0059 |
| Spun Yarn Diameter | 42.12 | 44.74 |
| Stress Cracks | Several | None |
| Broken Filaments on Draw Twister | 4 | 0 |
| Processing Time Lag | 1 hr. | 1 hr. |
| Denier | 145 | 146 |
| Tensile Strength | 1.16 lbs. | 1.40 lbs. |
| Tenacity | 3.63 gms/den | 4.35 gms/den |
| Elongation | 20.8% | 20.1% |

TABLE 3-continued

PHYSICAL PROPERTIES OF SPUN AND DRAWN YARN

| Type of Finish | Aqueous Base | Organic Solvent Base |
|---|---|---|
| Shrinkage | 11.5% | 11.5% |
| Modulus @ 1% Elong. | 156 | 175 |
| Birefringence | .141 | .157 |
| Diameter | 22.11 | 22.10 |
| I.V. | .465 | .472 |
| Melting Point | 249.4° C. | 249.0° C. |
| Carboxyl Content | 27 | 28 |

As may be determined by comparison of the spinning and draw twisting parameters, the reaction conditions for the two samples were identical except for the type of finish employed after spinning and before draw twisting. The processing time of one hour is well within the conventional production lag time. An immediate example of the improvement of the organic solvent base over the aqueous base was the elimination of broken filaments during the draw twisting operation. While denier, shrinkage, and elongation indicate very similar properties, an examination of the tensile strength, tenacity, and modulus indicate a significant improvement in the strength of the polyester yarn following the draw twisting. It is believed that the combination of the conventional emulsion with the organic solvent base unexpectedly improves the physical properties, even though the organic solvent further minimizes or eliminates circumferential stress cracking of the filaments. Specifically, the tenacity of the organic solvent base sample is significantly greater than the tenacity of the sample finish with the aqueous base.

While in accordance with the Patent Statues, a best mode and preferred embodiment of the invention has been disclosed, it is to be understood that the invention is not limited thereto or thereby. Consequently, for an understanding of the scope of the invention, reference is had to the following claims.

What is claimed is:

1. A process to minimize circumferential stress cracking in spun polyester filaments, comprising:

(a) mixing a miscible non-aqueous solution of a fiber finishing emulsion and an organic solvent, said emulsion having emulsifiers, lubricating oils, antistat oils and heat stabilizers; said organic solvent selected from the group consisting of: mineral oil, kerosene, and combinations thereof;

(b) melt spinning polyester fiber;

(c) contacting said solution with the fiber;

(d) storing the spun polyester; and (e) draw twisting the spun polyester to produce a spun polyester yarn having minimal circumferential stress cracks.

2. A process according to claim 1, wherein said contacting step further comprises the stages of:

(a) moving the fiber against means for communicating said solution with the fiber;

(b) transferring said solution with each fiber; and (c) absorbing said solution into each fiber, so that said solution lubricates each fiber for said draw twisting increasing the tenacity and tensile strength of each fiber and said organic solvent prevents crystallization of the surface of each fiber which create circumferential stress cracks.

3. A process according to claim 1, wherein said storing may exist from about 24 hours to about 90 hours.

* * * * *